US006309231B1

(12) United States Patent
Gordon et al.

(10) Patent No.: US 6,309,231 B1
(45) **Date of Patent: *Oct. 30, 2001**

(54) HIGH CURRENT MALE AND FEMALE POWER CONNECTOR ASSEMBLY

(75) Inventors: Keith Forbes Gordon; John Cameron, both of Fife (GB)

(73) Assignee: Litton Precision Products International, Inc., Glenrothes Fife (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/388,930

(22) Filed: Sep. 2, 1999

(51) Int. Cl.[7] ..... H01R 13/44
(52) U.S. Cl. ..... 439/140; 439/889
(58) Field of Search ..... 439/140, 332, 439/335, 346, 889

(56) References Cited

U.S. PATENT DOCUMENTS

| | | | | |
|---|---|---|---|---|
| 2,729,800 | | 1/1956 | Knudsen . | |
| 3,508,188 | * | 4/1970 | Buck . | |
| 4,796,159 | * | 1/1989 | Miksche | 361/421 |
| 4,818,237 | | 4/1989 | Weber . | |
| 5,015,195 | | 5/1991 | Piriz . | |
| 5,681,187 | | 10/1997 | Fukushima et al. . | |
| 5,685,730 | | 11/1997 | Cameron et al. . | |
| 5,921,823 | | 7/1999 | Bernardini . | |

* cited by examiner

*Primary Examiner*—Khiem Nguyen
(74) *Attorney, Agent, or Firm*—Lowe Hauptman Gilman & Berner, LLP

(57) ABSTRACT

Disclosed is a male and female power connector assembly in which the male contact is provided with a biased plunger which prevents insertion of a finger into contact with an electrically live component housed within the male connector. The female connector also includes a housing which prevents or induces the likelihood of an object coming into contact with an electrically live component on the female connector. The male and female power connector assembly of the present invention also includes a unique alignment and locking mechanism including a slot having a recessed area on the male for engagement with a tab in the female connector. Also a front flange in the male connector can have at least one slot for engagement with a pin in a pin connector in the female connector.

27 Claims, 3 Drawing Sheets

HIGH CURRENT MALE AND FEMALE POWER CONNECTOR ASSEMBLY

FIELD OF THE INVENTION

The present invention relates generally to electrical power connectors, and more specifically, to a male connector and a female connector forming a power connector assembly having a safety feature for reducing the likelihood of a person inadvertently coming into contact with an electrically-live metal component within the power connector assembly.

BACKGROUND OF THE INVENTION

It is well known that a high current electrical connection can be very dangerous. If a person comes into contact with an electrically live metal component, the person may be critically injured. Due to the large size of high current socket contacts in industrial plants, it is possible, using many typical electrical power connectors, for a person to insert a finger or other object into a socket opening and touch electrically live components within the socket. For example, in circuses and theatrical environments, a need exists to connect and disconnect high amperage circuits in locations which might be accessible to the public.

U.S. Pat. No. 5,921,823 to Bemardini, proposes a solution to the above-described problem. The '823 reference is hereby incorporated into this specification in its entirety. In the '823 patent, a female contact is provided for creating an electrical connection only upon insertion of a male plug. Insertion of a foreign object such as a finger will not produce a connection and thus there is no threat of electrocution. The female contact described in the '823 patent includes two separate areas, one which is energized (17) and one which is unenergized (15). Within the female contact is a biased plunger 21. The plunger is biased to a first position shown in FIG. 1 for blocking fingers and other extraneous objects from entering the female contact. The plunger can be moved by the male plug, against the spring biasing, to a position which completes the electrical connection between the male plug and the female contact. The '823 patent, however, does not describe any structure for preventing a person from contacting the energized area (17). Further, the '823 patent only describes a simple locking mechanism for locking the male and female contacts together.

Accordingly, needs still exist in the art to satisfy these requirements.

SUMMARY OF THE INVENTION

It is an object of the present invention to provide a male and female power connector assembly having a safety feature helping to prevent an individual from inserting a finger or other object into a socket opening and touching electrically live metal components within the socket.

It is another object of the present invention to provide a male and female power connector assembly in which all electrically live metal components are housed within electrically non-conductive housings.

It is yet another object of the present invention to provide a male connector in which an electrically live inner sleeve is housed within an electrically non-conductive housing.

It is yet another object of the present invention to provide a male and female power connector assembly having a unique locking mechanism for preventing longitudinal and rotational movement of the male and the female connectors when in a coupled position.

It is yet another object of the present invention to provide a male and female power connector assembly which is reliable in operation, and cost effective to manufacture.

The present invention is directed to a male and female power connector assembly in which the male contact is provided with a biased plunger which prevents insertion of a finger into contact with an electrically live component housed within the male connector. The female connector also includes a housing which prevents or renduces the likelihood of an object coming into contact with an electrically live component on the female connector. The male and female power connector assembly of the present invention also includes a unique alignment and locking mechanism including a slot having a recessed area on the male connector for engagement with a tab in the female connector. Also a front flange in the male connector can have at least one slot for engagement with a pin in the female connector.

These and other objects of the present invention are achieved by the male connector for insertion into a female connector. The male connector includes an outer sleeve having a large diameter entry bore for receiving the female connector. An electrically energizable inner sleeve is provided. The outer sleeve is an electrical insulator. A biased plunger is positioned radially inwardly from the inner sleeve for preventing unauthorized access from the outer sleeve to the inner sleeve and is adapted to move in response to a longitudinally directed force by the female connector from a first position to a second position for electrically connecting the female connector to the energizable inner sleeve.

The foregoing and other objects of the present invention are achieved by an electrical connector assembly which includes a male connector including an outer sleeve having a large diameter entry bore and an electrically energizable inner sleeve. A biased plunger is positioned radially inwardly from the inner sleeve and movable from a first position beyond the inner sleeve to a second position within the inner sleeve A female connector includes an outer sleeve having a large diameter entry bore for receiving the male outer sleeve, a pin having an electrically non-conductive front portion and an electrically energizable portion. When the pin is brought into contact with the biased plunger, the biased plunger is moved from the first position to the second position and the electrically energizable portion of the pin is brought into contact with the electrically energizable sleeve.

The foregoing and other objects of the present invention are achieved by a method of coupling a male connector and female connector to prevent longitudinal and rotational movement when in a coupled position. The male connector and the female connector are aligned such that a pin in the female connector is aligned with a slot in the male connector and such that a tab in the female connector is aligned with a groove in the male connector. The male connector is pushed into the female connector to compress a spring biased pin. One of the male connector and the female connector is rotated to engage the pin with a flange in the male connector and to engage the tab with a recess in the male connector to thereby prevent longitudinal movement of the male connector relative to the female connector and to engage the spring biased pin with a groove in the female connector to thereby prevent rotational movement of the male connector relative to the female connector.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
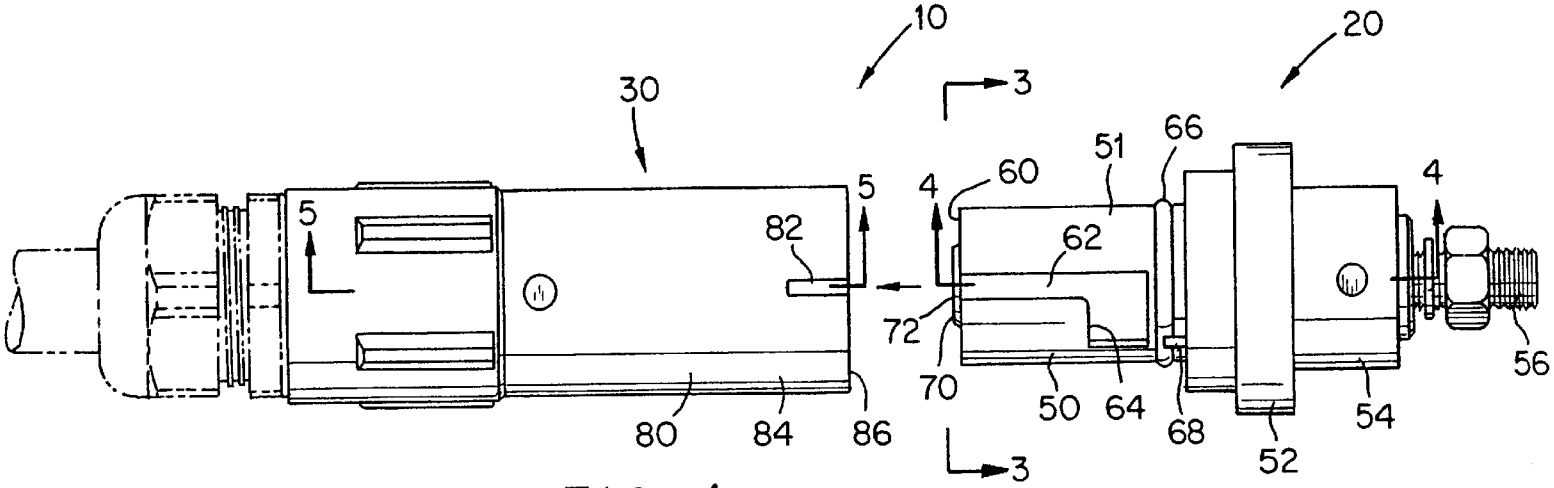
FIG. 1 is a side elevational view of the male and female power connectors according to the present invention depicted in an uncoupled position.

Refer now to FIG. 1 where a power connector assembly, generally indicated at 10, according to the present invention, is depicted in an uncoupled horizontal position. For convenience, the invention has been described with reference to the orientation depicted and accordingly terms such as "left", "right", "above" and "below" are to be construed in the relative sense. The power connector assembly 10 includes a male connector 20 and a female connector 30. The male connector 20 includes a body 50 formed from an electrically insulating material, such as plastic. The male connector 20 includes generally a front cylindrical portion 51, a flange portion 52 and a rear portion 54. The male connector 20 can be connected to a source of high voltage using a conventional threaded connector 56. The front portion 51 has a front surface 60 and at least one rearwardly extending slot 62 which extends from the front surface 60 rearwardly towards the flange 52. The slot 62 terminates in front position in a recessed portion 64 as depicted in FIG. 1. Although only one slot 62 is depicted in FIG. 1, it can be appreciated that more slots can be used, most preferably two in the presently preferred embodiment. An o-ring 66 is located between the termination of recess 64 and the flange 52. A biased electrically non-conductive plunger 70 has a front surface 72 extending forwardly beyond the front surface 60 as depicted in FIG. 1.

Figure 2A:
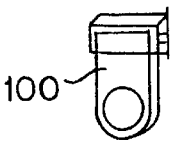
FIG. 2A is a partial schematic view of a key used in uncoupling the male and the female connectors from the coupled position.
Figure 2:
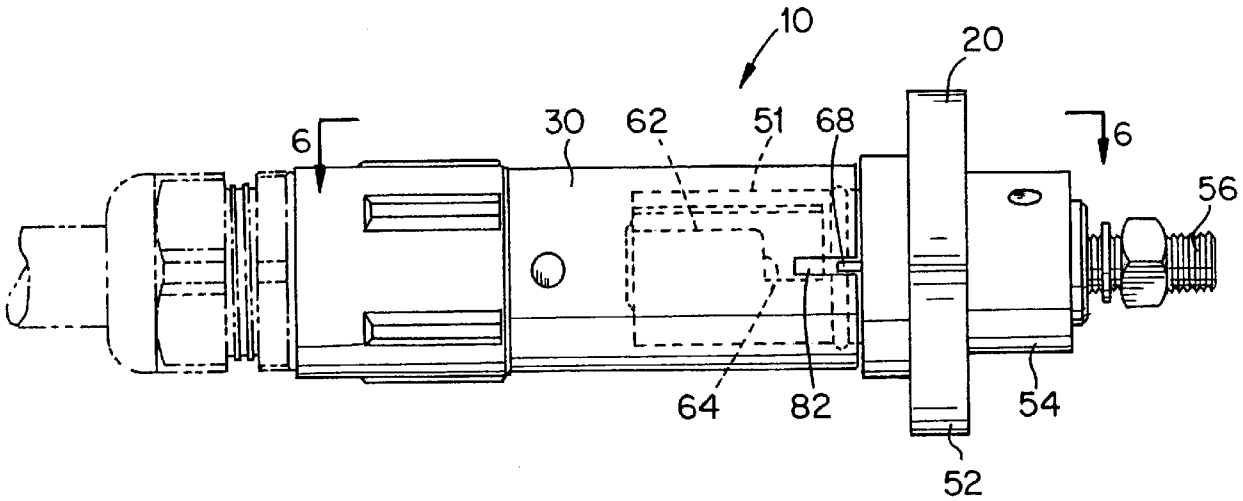
FIG. 2 is a side elevational view of the connector assembly of FIG. 1 depicted in a coupled position.

The female connector 30 includes a generally cylindrical electrically non-conductive body 80 having a slot 82 extending inwardly from an outer surface 84 of housing 80. The slot 82 extends from a forward surface 86 as depicted in FIG. 1. The female connector can be connected to a source of electrical power. A spring biased pin 68 extends forwardly from flange 52 in the male connector 20 and engages with the slot 82 as depicted in FIG. 2. The spring biased pin 68 and other details of the locking mechanism are described in commonly assigned U.S. Pat. No. 5,685,730, the disclosure of which is hereby incorporated by reference in its entirety into the instant application.

Figure 3:
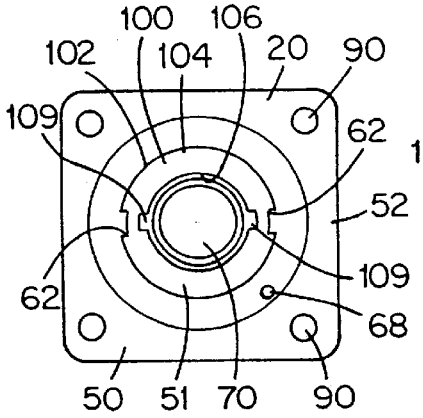
FIG. 3 is a left elevational view of the male connector taken along lines 3—3 in FIG. 1.

In FIG. 3, a left elevational view of the male connector 20 is depicted. The front portion 51 of the housing 50 includes a cylindrical wall 100 having an outer surface 102, an inwardly extending front flange portion 104. The front flange portion 104 has an inner surface 106 and the wall 100 has an inner surface 108. A pair of slots 109 are formed in the flange portion 104. An electrically conductive cylindrical inner sleeve 120 is positioned within inner wall 108. The inner sleeve 108 has a front shoulder 122 and a rear flat surface 124. The rear surface 124 is in contact with the threaded connector 56.

Figure 4:
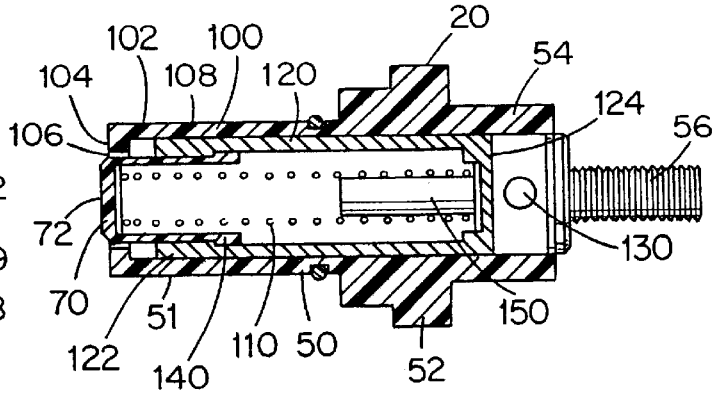
FIG. 4 is a cross-sectional view of the male connector according to the present invention taken along lines 4—4 in FIG. 1.

As depicted in FIG. 4, the threaded connector 56 is pinned to the housing 50 using a pin 130 to prevent relative movement. The plunger 70 is biased by a compression spring 110. The plunger 70 has a rear shoulder 140 which is depicted in FIG. 4 in abutting relation with the front shoulder 122 of the inner sleeve 120. The connector 56 can have a forwardly extending pin portion 150 for keeping the spring 110 in alignment and also for limiting rearward travel of the plunger 70 as discussed in detail below.

Figure 5:
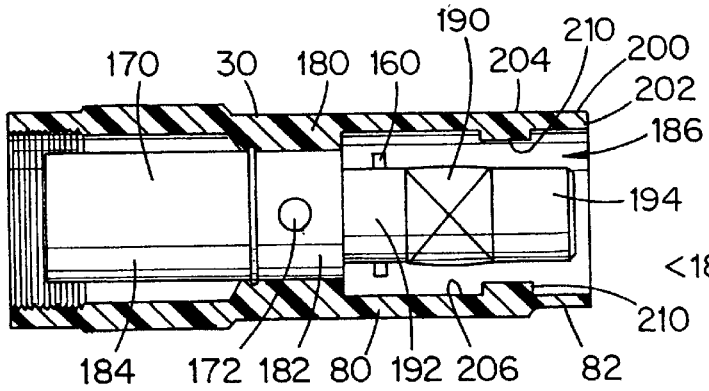
FIG. 5 is a cross-sectional view of a female connector taken along lines 5—5 in FIG. 1.
Figure 5A:
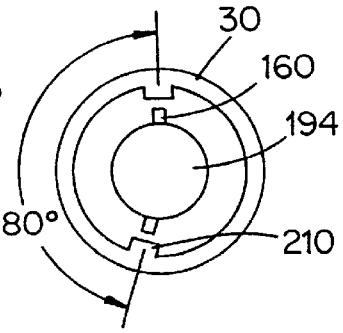
FIG. 5A is a right side elevational view of the female connector of FIG. 5.

Refer now to FIGS. 5 and 5A in which a cross-sectional view of the female connector 30 is depicted. The female connector 30 includes the body 80 into which a male contact assembly 170 is positioned. The male contact assembly 170 is pinned to the body 80 using a pin 172 to prevent relative movement. The body 80 includes an intermediate shoulder portion 180. The male contact assembly 170 has an intermediate portion 182 through which the pin 172 is placed. A rearward portion of the male contact assembly 170 extends rearwardly from the intermediate portion 182 and can be connected to a source of electrical power. A forward portion 186 of the male contact assembly 170 includes a louver band 190. The louver band 190 can be either a single, double or multi-louver spring band depending on the voltage applied. The use of louver spring bands allows for a large current flow. The biased plunger 70 slides back and forth within the inner sleeve 120 in order to provide access by the louver 190 to the inner sleeve 120. Insertion of the male connector 20 into the female connector 30 creates an electrical circuit between the louver 190 and the inner sleeve 120. The electrical path goes from the electrically energized inner sleeve 120 to the louver 190 via the louver spring bands. To prevent arcing, the coupling and uncoupling of the male connector 20 and the female connector 30 should not be connected or disconnected under load.

Between the louver band 190 and the central portion 182 of the male contact assembly 170 is an electrically conductive portion 192 through which a pin 160 is transversely positioned. The pin 160 extends radially outwardly from the electrically conductive portion 192. A front portion 194 of the male contact assembly 170 is electrically non-conductive and can be made from a plastic material, for example, Teflon. A front portion 200 of the body 80 forms a recess into which the front portion 194 is positioned. The front portion 200 has a wall 202 having an outer surface 204 and an inner surface 206. The slot 82 extends inwardly from the outer wall 204. A pair of tabs 210 extend radially inwardly from the inner surface 206 and are diametrically opposed from each other. It should be noted that the electrically conductive portion 190 would be difficult to reach with an individual's finger because of the close proximity of the inner surface 206 and the outer diameter of the front portion 194.

Figure 6:
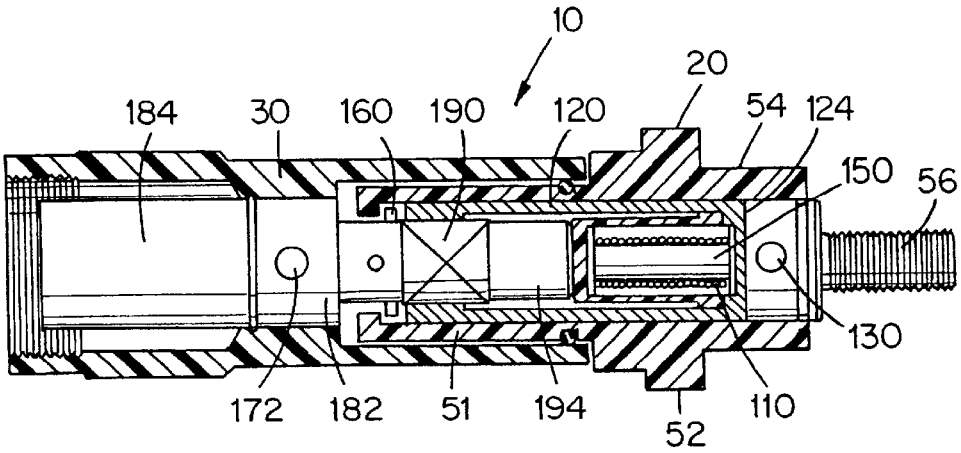
FIG. 6 is a cross-sectional view of the connector assembly taken along lines 6—6 of FIG. 2.

Refer now to FIGS. 2 and 6 which depict the male connector 20 and female connector 30 in the coupled position. In operation, the tabs 210 must first be aligned with the slots 62. As previously noted, the slots 62 and the tabs 210 are not exactly 180° apart and therefore there is only a single alignment orientation in which the male connector 20 can be aligned with the female connector 30. Upon insertion of the male connector 20 into the female connector 30, physical contact is made between the front portion 194 and the biased plunger 70. The inward force applied by front portion 194 depresses the compression spring 110 allowing the non-conductive plunger 70 to recede into a bore formed within the inner sleeve 120. When the male connector 20 is fully inserted into the female connector 30, a forward surface of pin 68 is brought into contact with surface 86 of the female connector 30. Pin 68 is spring biased and is fully compressed when the male connector 20 and the female connector 30 are fully pushed together. Once the male 20 and the female 30 connectors are fully pushed together in the longitudinal direction, as depicted in FIGS. 1, 2 and 6, the male connector 20 is rotated in a clockwise direction, thereby locking pin 68 into slot 82.

When pushed in the longitudinal direction, the slots 109 are aligned and pass over pins 160. The tabs 210 extend into the recessed area 64 and when rotated the male connector 20 is retained in a longitudinal direction in the female connector by a combination of pins 160 engaging the flange 104 and also the tabs 210 engaging the recess 64. Rotation between the male connector 20 and the female connector 30 is prevented by the engagement of the pin 64 into the slot 82. Decoupling of the male connector 20 and the female connector 30 is accomplished with reference to FIG. 2 where a key 100 is inserted into slot 82. The width of the key 100 is such that insertion into the slot 82 fully compresses pin 68, thereby allowing rotation of the male connector 20 relative to the female connector 30. After insertion of the key 100, a slight counter clockwise rotation of the male connector 20 under the bias of the spring 110 fully uncouples the male connector 20 from the female connector 30.

Figure 7:
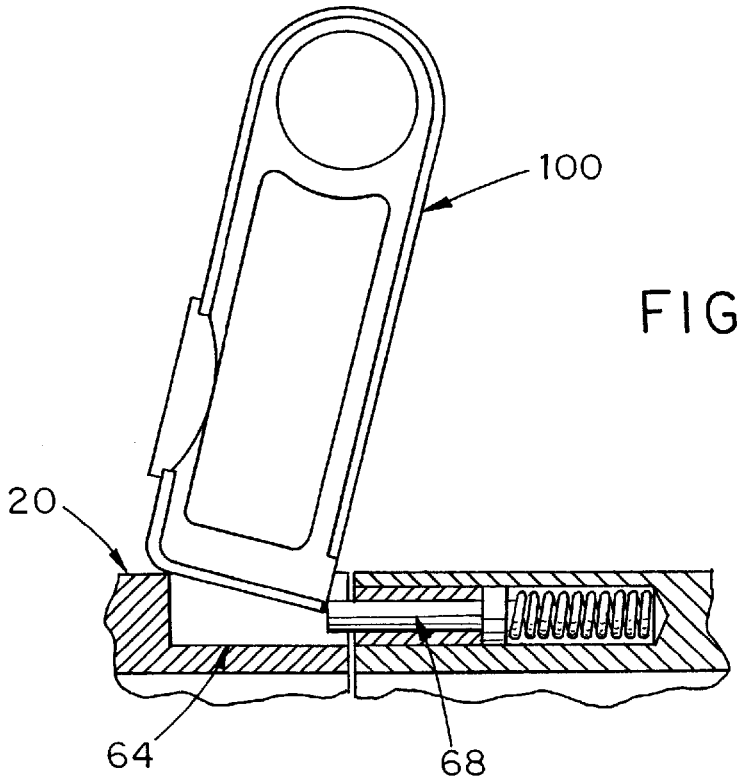
FIGS. 7 and 8 show a suitable tool for unlocking the secondary locking device.
Figure 8:
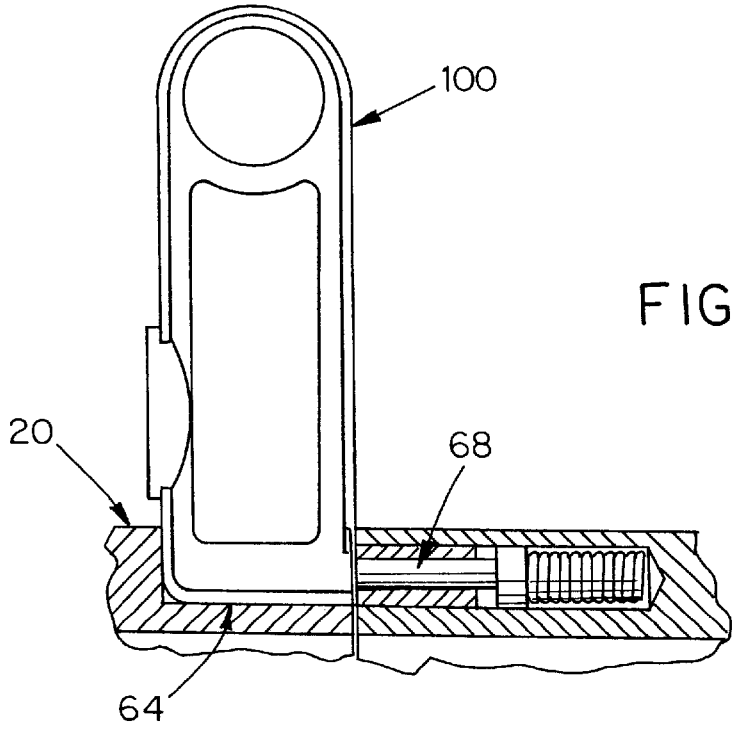

When it is desired and permitted to disengage the connector, a tool 100 may be used as shown in FIGS. 7 and 8. FIG. 7 shows the plug 30 and the receptacle 20 engagement with the pin 68 in the slot 64 so as to prevent their unlocking. As shown, the tool 100 can be inserted into slot 64 to push pin 68 back into plug 30, thus unlocking the connector and allowing it to be rotated. FIG. 8 shows how, by making the tool 100 a dimension to substantially exactly fit the slot, it can be retained in place by the pressure of the pin 68 with the connector unlocked, so that both of a user's hands are free to disengage one portion of the connector from the other. This is of particular advantage in the case of the cable-to-cable connector shown in FIG. 2.

It should now be apparent that a unique electrical power connector has been described in which the electrically energized portions are shrouded by electrically non-conductive housings. Further, advantageously, there is a unique retention system described for retaining the male connector and female connector together and also a unique anti-rotation lock has also been described.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. A male connector for insertion into a female connector having at least one key, said male connector comprising:

an electrically non-conductive outer sleeve having a large diameter entry bore for receiving the female connector, said sleeve having an L-shaped slot for receiving the at least one key via a first leg of said L-shaped slot, such that upon rotation of said male connector and said female connector relative to each other, said at least one key enters a second leg of said L-shaped slot, said second leg being perpendicular to said first leg, thereby locking said male and female connectors;

an electrically energizable inner sleeve; and a biased electrically non-conductive plunger positioned radially inwardly said inner sleeve for preventing unauthorized access from said outer sleeve to said inner sleeve and adapted to move in response to a longitudinally directed force by the female connector from a first position to a second position for electrically connecting the female connector to said energizable inner sleeve.

2. The male connector of claim 1, wherein said biased plunger includes:

a spring which, when uncompressed, biases said biased plunger into said first position, and wherein said non-conductive plunger which permits the female connector to enter and contact said inner sleeve when said spring is compressed such that said plunger is moved to said second position.

3. The male connector of claim 1, wherein the female connector includes a louver band to connect said inner sleeve and the female connector and when said band is compressed the band surrounds a male contact of the female connector such that said louver band contacts said inner sleeve and the male contact when said biased plunger is in said second position, thereby providing electrical contact between said inner sleeve and the male contact for energizing the female connector.

4. The male connector of claim 3, wherein said louver spring is positioned within the female connector.

5. The male connector of claim 3, wherein said biased plunger is partially recessed within a bore in said inner sleeve.

6. The male connector of claim 1, wherein said biased plunger includes a shoulder and said inner sleeve includes a shoulder, each of said shoulders being in abutting relation when said biased plunger is in said first position.

7. The male connector of claim 1, wherein said inner sleeve is connected to a source of electrical power.

8. The male connector of claim 1, wherein said inner sleeve is connected to cable termination means and wherein said cable termination means comprises one of either a threaded bolt, a crimp, a solder barrel or a flat blade.

9. The male connector of claim 1, wherein said outer sleeve has a radially inwardly extending flange located near said biased plunger when said biased plunger is in said first position.

10. The male connector of claim 1, wherein the female connector includes a pin having an electrically conductive portion and an electrically nonconductive portion and a pin extending transversely through said conductive portion and wherein said outer sleeve has a radially inwardly extending shoulder having slots, the female connector pin alignable with said slots.

11. The male connector of claim 1, wherein said outer sleeve is electrically non-conductive.

12. The male connector of claim 1, further comprising at least one slot in said outer sleeve and at least one corresponding mating tab in the female connector.

13. The male connector of claim 1, wherein the outer sleeve includes two longitudinal slots extending from a front end of said outer sleeve and terminating in a rearwardly extending transverse slot portion, and wherein the female connector includes two tabs for alignment with said two corresponding longitudinal slots, and wherein said two tabs are brought into engagement with said transverse slot portions when said plunger is in said second position and said male connector is rotated relative to said female connector.

14. The male connector of claim 13, wherein said two slots are located less than 180° apart.

15. The male connector of claim 13, wherein said outer sleeve includes a front flange, said front flange having a pair of slots, and wherein the female connector includes a pin extending transversely through a male contact assembly in the female connector, wherein said pin engages said front flange when said male connector and the female connector are in a coupled position.

16. The male connector of claim 1, further including a spring biased pin and wherein the female connector has a longitudinal slot, said spring biased pin engageable with said slot when said male connector and the female connector are in a coupled position.

17. An electrical connector assembly, comprising:

a male connector including:

an outer sleeve having a large diameter entry bore;

an electrically energizable inner sleeve;

a biased electrically insulated plunger positioned radially inwardly said inner sleeve and movable from a first position beyond said inner sleeve to a second position within said inner sleeve;

a female connector including:

an outer sleeve having a large diameter entry bore for receiving said male outer sleeve;

a pin having an electrically non-conductive front portion and an electrically energizable portion;

a bayonet locking mechanism for locking said male and said female connector upon rotation of said male and connectors in a first direction relative to each other and unlocking said connectors upon rotation of said male and female connector portions in an opposite direction relative to each other;

wherein when said pin is brought into contact with said biased plunger, said biased plunger is moved from said first position to said second position and said electrically energizable portion of said pin is brought into contact with said electrically energizable sleeve.

18. The electrical connector assembly of claim 17, further comprising means for preventing longitudinal movement of said male connector and said female connector when said male connector and said female connector are in a coupled position.

19. The electrical connector assembly of claim 17, further comprising means for preventing rotation of said male connector and said female connector when said male connector and said female connector are in a coupled position.

20. The electrical connector assembly of claim 17, further including a louver bond to connect said inner sleeve of the male connector and the female connector and when said spring is compressed the spring surrounds a conductive pin of the female connector such that said louver bond contacts said inner sleeve and the conductive pin when said biased plunger is in said second position, thereby providing electrical contact between said inner sleeve and the conductive pin for energizing the female connector.

21. The electrical connector assembly of claim 17, wherein the outer sleeve includes two longitudinal slots extending from a front end of said outer sleeve and terminating in a rearwardly extending transverse slot portion, and wherein the female connector includes two tabs for alignment with said two corresponding longitudinal slots, and wherein said two tabs and brought into engagement with said transverse slot portions when said plunger is in said second position and said male connector is rotated relative to said female connector.

22. The electrical connector assembly of claim 21, wherein said two slots are located less than 180° apart.

23. The electrical connector assembly of claim 21, wherein said outer sleeve includes a front flange, said front flange having a pair of slots, and wherein the female connector includes a pin extending transversely through a male connector assembly in the female connector, wherein said pin engages said front flange when said male connector and the female connector are in a coupled position.

24. The electrical connector assembly of claim 17, further including a spring biased pin and wherein the female connector has a longitudinal slot, said spring biased pin engageable with said slot when said male connector and the female connector are in a coupled position.

25. A method of coupling a male connector and female connector to prevent longitudinal and rotational movement when in a coupled position, comprising:

aligning the male connector and the female connector such that a pin in the female connector is aligned with a slot in the male connector and such that a tab in the female connector is aligned with a groove in the male connector;

pushing the male connector into the female connector to compress a spring biased pin;

rotating one of the male connector and the female connector to engage the pin with a flange in the male connector and to engage the tab with a recess in the male connector to thereby prevent longitudinal movement of the male connector relative to the female connector and to engage the spring biased pin with a groove in the female connector to thereby prevent rotational movement of the male connector relative to the female connector.

26. The electrical connector assembly of claim 17, comprising a secondary locking mechanism for preventing rotation of said male and female connector in said opposite direction relative to each other, thereby preventing accidental disconnection of said male and female connectors, said secondary locking mechanism being comprised of a slot disposed in said female connector, a pin disposed in said male connector portion and a spring connected to said pin for urging said pin into said slot when said male and female connectors are locked via said bayonet locking mechanism, said secondary locking mechanism requiring the insertion of a tool into said slot for retraction of said pin out of said slot to permit rotation of said female and said male connectors for unlocking of said male connector from said female connector.

27. The electrical connector assembly of claim 26, wherein said pin and spring are disposed within a hole in said male connector portion, said pin has an enlarged portion at one end being of sufficient dimensions to compress said spring while sliding freely within said hole and a collar is provided around said pin in secure relation to said hole so as to bear against said enlarged portion when said pin is urged into said slot, thereby preventing removal of said pin from said hole.

* * * * *